US006929253B2

(12) United States Patent
Marks

(10) Patent No.: US 6,929,253 B2
(45) Date of Patent: Aug. 16, 2005

(54) QUICK ACTION BAR CLAMP WITH IMPROVED STIFFNESS AND RELEASE BUTTON

(75) Inventor: Joel Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 15 days.

(21) Appl. No.: 10/406,204

(22) Filed: Apr. 4, 2003

(65) Prior Publication Data

US 2004/0195746 A1 Oct. 7, 2004

(51) Int. Cl.[7] ..... B25B 5/02
(52) U.S. Cl. ..... 269/6; 269/3; 269/170
(58) Field of Search ..... 269/6, 3, 165–171.5, 269/143; 81/487

(56) References Cited

U.S. PATENT DOCUMENTS

| | | | | | |
|---|---|---|---|---|---|
| 5,375,309 | A | * | 12/1994 | Dunn | 29/237 |
| 6,386,530 | B1 | * | 5/2002 | Marks | 269/6 |
| 6,578,837 | B1 | * | 6/2003 | Blank et al. | 269/6 |
| 6,648,315 | B1 | * | 11/2003 | Lee | 269/6 |
| 6,655,670 | B1 | * | 12/2003 | Liou | 269/6 |
| 6,746,006 | B2 | * | 6/2004 | Thomas | 269/6 |

* cited by examiner

*Primary Examiner*—Lee D. Wilson
(74) *Attorney, Agent, or Firm*—Brad I. Golstein

(57) ABSTRACT

A bar clamp operates by squeezing a handle to close a jaw. The improvements of the present invention include: A rigid locking wedge geometry wherein the wedges are parallel to each other, a simplified wire form release element, a structure for retaining a jaw locking knob upon the jaw, and a snap fitted gripping pad.

10 Claims, 11 Drawing Sheets

QUICK ACTION BAR CLAMP WITH IMPROVED STIFFNESS AND RELEASE BUTTON

FIELD OF THE INVENTION

The present invention relates to clamping tools. More precisely the present invention relates to one hand squeeze operated bar clamp tools using wedges to bind a bar.

BACKGROUND OF THE INVENTION

The present invention discloses improvements to the quick action clamp of U.S. Pat. No. 6,386,530 which is incorporated herein in its entirety by reference.

Squeeze operated clamps are well known. The related art uses an elongated plate to bind a bar at an angle to create a drive or locking action. A familiar application of this method is shown in British Patent 1555455 which shows a caulking gun device. A driving plate 41 and a locking plate 51 are fitted around a shaft. Each plate has a biasing spring also surrounding the shaft.

U.S. Pat. No. 4,926,722, 5,009,134 and 5,022,137 are some of a series to J. Sorensen et al covering a squeeze operated bar clamp. The '134 reference shows a retractable setscrew holding the jaw in place. A locking plate is positioned in front of a trigger handle. A compression spring surrounds the bar and presses a drive plate forward. The drive plate and drive spring are held in position by the bar. In FIG. 9 of '134 a locking plate is shown behind the trigger handle. U.S. Pat. No. 6,412,767 shows a variation of the Sorensen clamps with a removable jaw. The jaw is held to the bar by engaging a separate stop element of the bar. No new internal structures in the housing area are disclosed over the '137 or other references.

U.S. Pat. No. 5,005,449 shows a further version of a squeeze actuated clamp in which the trigger handle is parallel to the bar and the handle is squeezed toward the bar.

U.S. Pat. No. 5,161,787 shows in FIG. 3 a shaft driving apparatus. A two speed action is provided through the use of a flexible linkage 90 and a rigid linkage 75. The leverage from handle 34 depends upon the force required of bar 26. The bar moves the opposite direction from the handle motion. Compression spring 38 is surrounded at its non-moving end by ribs of the body structure. The other spring end which presses the drive plate is positioned only by the bar passing within the spring.

U.S. Pat. No. 5,853,168 shows a clamp similar to that of Sorensen except that the clamping jaws point down and the locking plate extends upward directly above the trigger handle. The drive and lock plates are positioned within the housing by a rib 31. The drive plate bias spring 22 is positioned in a similar manner to '787 above. As seen in FIG. 2 of '168 the front end of spring 22 is held in position only by bar 12.

U.S. Pat. No. 4,874,155 shows a C-clamp where locking plate release 13 faces rearward. The lock plate spring is positioned around the bar. A drive plate spring is mounted to a shaft separate from the bar. The bar moves in the opposite direction from the handle motion.

In U.S. Pat. Nos. 4,524,650 and 4,739,838, a varying speed lever mechanism for a screwdriver is disclosed. The levers include various sliding and pivoting linkages.

U.S. Pat. No. 669,282, from 1901, shows a jaw element movable along a bar. A setscrew contacts the bar to prevent such movement. U.S. Pat. No. 5,454,551 shows a jaw that is movable upon the bar by tilting the jaw.

In the clamping devices general design types are seen. One type is a C-clamp where the body of the tool is C shaped. The bar moves oppositely from the trigger handle mounted at the base of body. A caulking gun is also in this category. A second version is a bar clamp where the bar is drawn toward the body in the same direction as the handle is moved. The present invention is directed to the pistol grip bar clamp. In a pistol grip design a part of the housing body extends downward in parallel to a trigger handle such that the handle extends substantially perpendicular to the movable bar. The jaws may be above or below the bar in a pistol grip design. The mechanical limitations and requirements are different between a C clamp and a bar clamp.

SUMMARY OF THE PRESENT INVENTION

The present invention provides several improvements to the function of a one-hand squeeze operated bar clamp. The bar and jaw end are both easily removable so that a different length bar can be used with the same tool body. The bar advance action is very fast without loss of clamping force. An easily accessed and intuitive release button is positioned at the side of the tool. The design is comfortable to hold and operate. The drive and lock wedge plates are strengthened by use of a bent channel cross section. A torsion spring is used to bias the drive wedge to allow minimal resistance through a long drive stroke.

The improvements of the present invention may also be of benefit to caulking guns and other such devices.

The bar is entirely separable from the clamp components. A user can easily install a longer bar without the need to purchase another complete clamp. In addition the bar can be pulled out and inserted into the rear; if the jaw end is reversed to face away from the clamp body and attached to the bar behind the body a spreading device is created. An improvement of the invention is that when the bar is removed the internal components will not fall out of position. In particular the drive and lock wedges, and the bias spring do not depend on the bar to hold them in position. In a preferred embodiment the wedges are contained entirely within the body, with the locking wedge linked to a release button or lever. Ribs or notches of the housing body contain the wedges vertically, and the housing walls contain them horizontally. In a preferred embodiment the bias spring is a torsion spring with one spring end pressing behind the drive wedge. The spring coil is supported around a post or feature in the housing. The spring end is therefore also positioned within the housing and does not depend on the bar to be secure.

A prior art spring is shown in FIG. 3 of U.S. Pat. No. 5,161,787. In this design the spring is secured only at its non-moving end. The ribs surrounding the spring extend well short of drive plates 68. If the spring is to remain stable when the bar is removed the space between the drive plates and the ribs around the fixed end of the spring must be small The drive stroke must also then be small If the space is large enough to enable large wedge plate motion and bar speed, then the spring will have a long unsupported end near the plates when the bar is removed. Especially if the tool is bumped or dropped with the bar removed the spring will fall out of position at the plate and it will be difficult to reinstall the bar. Therefore while both U.S. Pat. Nos. 5,161,787 and 5,853,168 disclose methods to hold wedging plates in position with the bar removed, neither provides a reliable solution to hold the spring.

The drive action of the present invention has a long stroke to enable fast closing. This makes it unnecessary to use a second hand to close the jaw. To maintain a reasonable grip distance the leverage from the handle to close the jaw varies according to the handle position. In its more extended position the handle provides high leverage and therefore high closing force. As the handle is squeezed rearward the relative speed of the bar increases. In the rear portion of the handle travel a small squeeze motion produces a large bar motion. Both high speed and high force are provided by use of varying leverage with a moving fulcrum. No complex linkages are required. The mechanism operates with low friction.

To make a high-speed action practical the device must operate efficiently. Efficiency in this case comprises: low friction, full use of a hand grip distance, and comfortable features and shape.

Another improvement of the invention is the side located release button. The locking wedge is enclosed within the housing and is linked to the user by the release button. The button is accessible by the thumb when the tool is used right-handed. All of the fingers on the trigger handle can remain in place as the release is engaged. However the button is also positioned to facilitate left hand use where testing has shown that the middle finger can easily reach back to operate it. Either way this easy access helps when doing fine adjustments where alternate clamping and releasing actions are needed.

In the present invention a simplified release button and linkage is disclosed. A single wire form includes a loop shaped pressing button at one end, a long rotation axle, and a small off-axis actuating end.

Also of importance is the release operation as it is often performed in real applications. Most typically an object is being held to a horizontal surface and the clamp faces downward. With the side release button a user grabs the tool body, squeezes the release button and pulls the tool away. This occurs as one continuous motion.

A release lever in front of the handle requires a reduction in usable handle travel in the pistol grip design. The release lever will define the total gripping distance. The trigger handle that is behind the release lever must then be less than this total gripping distance. This leads to a wasted opportunity when it is desired to have the fastest and easiest possible operation wherein all of a user's practical grip motion should be used to advance the bar. The distance between the release lever and the trigger handle defines the wasted opportunity of handle motion. Although a small handle motion can be amplified to a large bar motion by appropriate leverage, the faster motion leverage requires higher squeezing effort, and any friction in the system is amplified.

The prior art releases on the back or top are not convenient for one hand use. Particularly for the pistol grip bar clamp there is no way for the gripping hand to access such releases.

Observation of inexperienced users has indicated another disadvantage to the forwardly positioned release lever. The release lever resembles an operating handle and initial users squeeze the release lever when the intent is actually to advance the bar. After it does not work as expected the user must study the tool to locate the actual trigger handle. In U.S. Pat. No. 5,009,134 FIG. 9 shows an alternate embodiment clamp with a locking lever behind the handle "where preventing inadvertent activation of the braking lever is desired" (Col. 5, lines 52–55). However the locking lever of FIG. 9 is not easily accessed. A more intuitive design for the release device is needed.

Another improvement of the present invention is the balance and comfort of holding the tool. The tool body and handle provide surfaces to support the tool on the hand with the hand in a natural position. Especially with the bar extended the handle extension provides support for the cantilevered weight of the bar.

In the present invention a retractable stem passes through the jaw and bar to hold the jaw upon the bar. A knob at one end of the stem includes an undercut to form a limit stop. The knob with stem will not separate from the jaw and thus will not be misplaced. A cam provides a bias to create a gentle snap action whereby the knob is biased either in its fully engaged position or its fully retracted position.

DETAILED DESCRIPTION OF THE ILLUSTRATED EMBODIMENT

Figure 1:
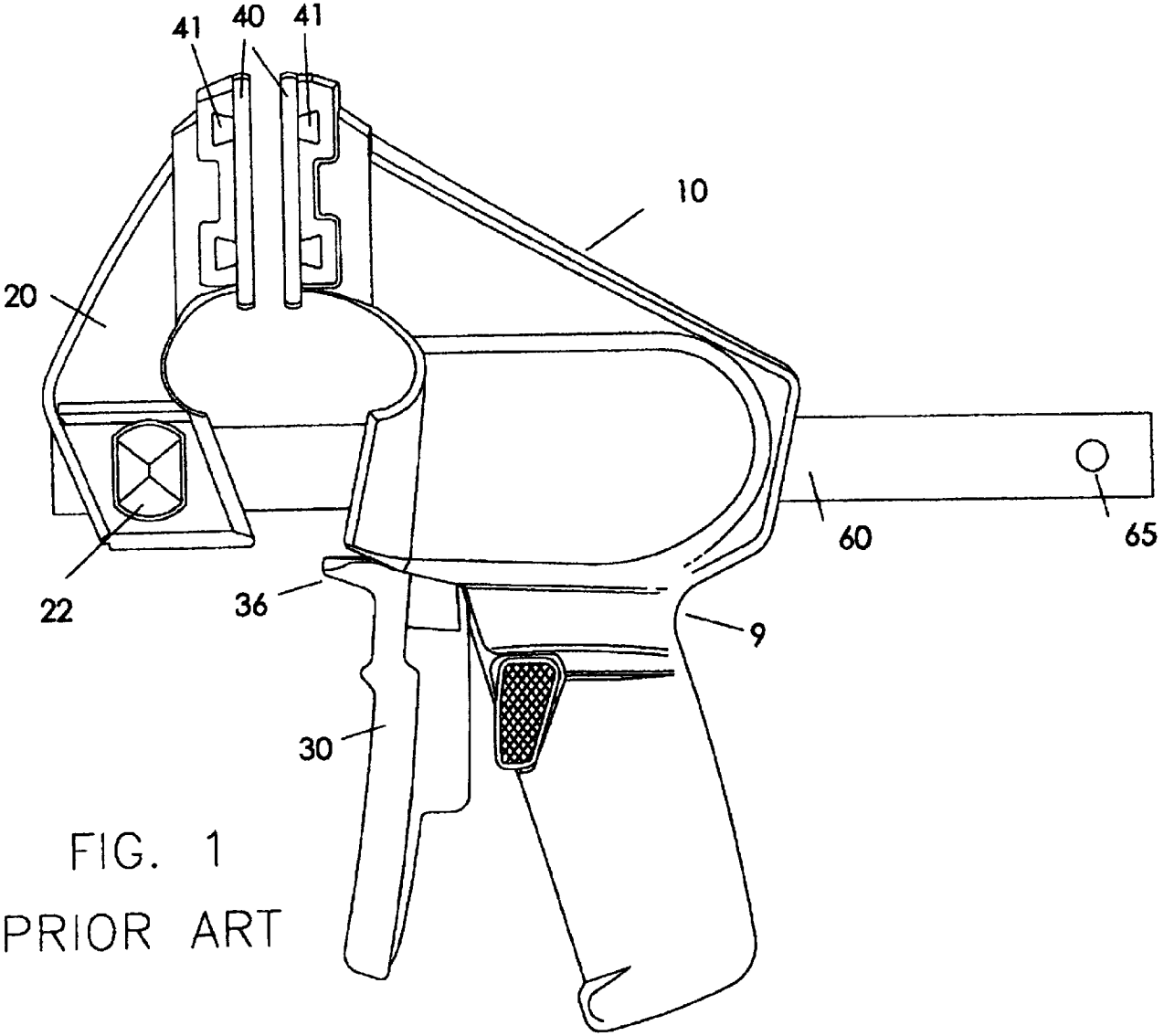
FIG. 1 PRIOR ART
FIG. 1 is a side elevation of a quick action clamp according to one embodiment of the invention.

FIG. 1 shows a general view of one embodiment of the clamp. A housing body 10 supports pivotable handle 30. Housing 10 and handle 30 may be molded plastic or die cast metal. In the case of plastic a glass filled nylon or polycarbonate may be used. Bar 60 is slidably disposed through the central portion of housing 10. Release button 53 is on at least one side of housing 10, to the rear of handle 30. Jaw end 20 is releasably held to bar 60 by knob 22. Rubber pads 40 may be fitted to the two facing clamping surfaces and held to the tool by ribs 41 engaging corresponding slots. Ribs 41 may have a "dovetail" shape.

Figure 2:
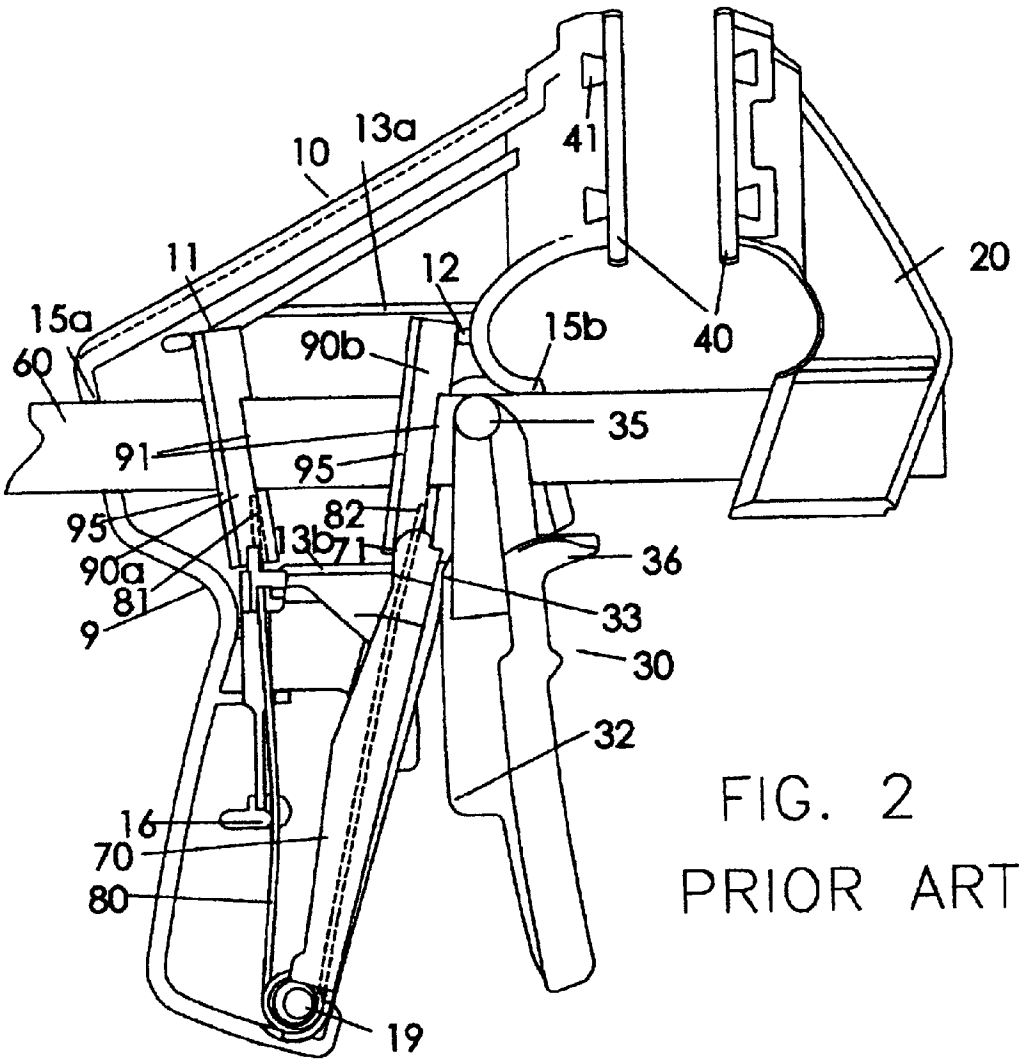
FIG. 2 PRIOR ART
FIG. 2 is the clamp of FIG. 1, with one side of a housing body removed showing the internal components in a high force mode, with a handle fully extended.
Figure 3:
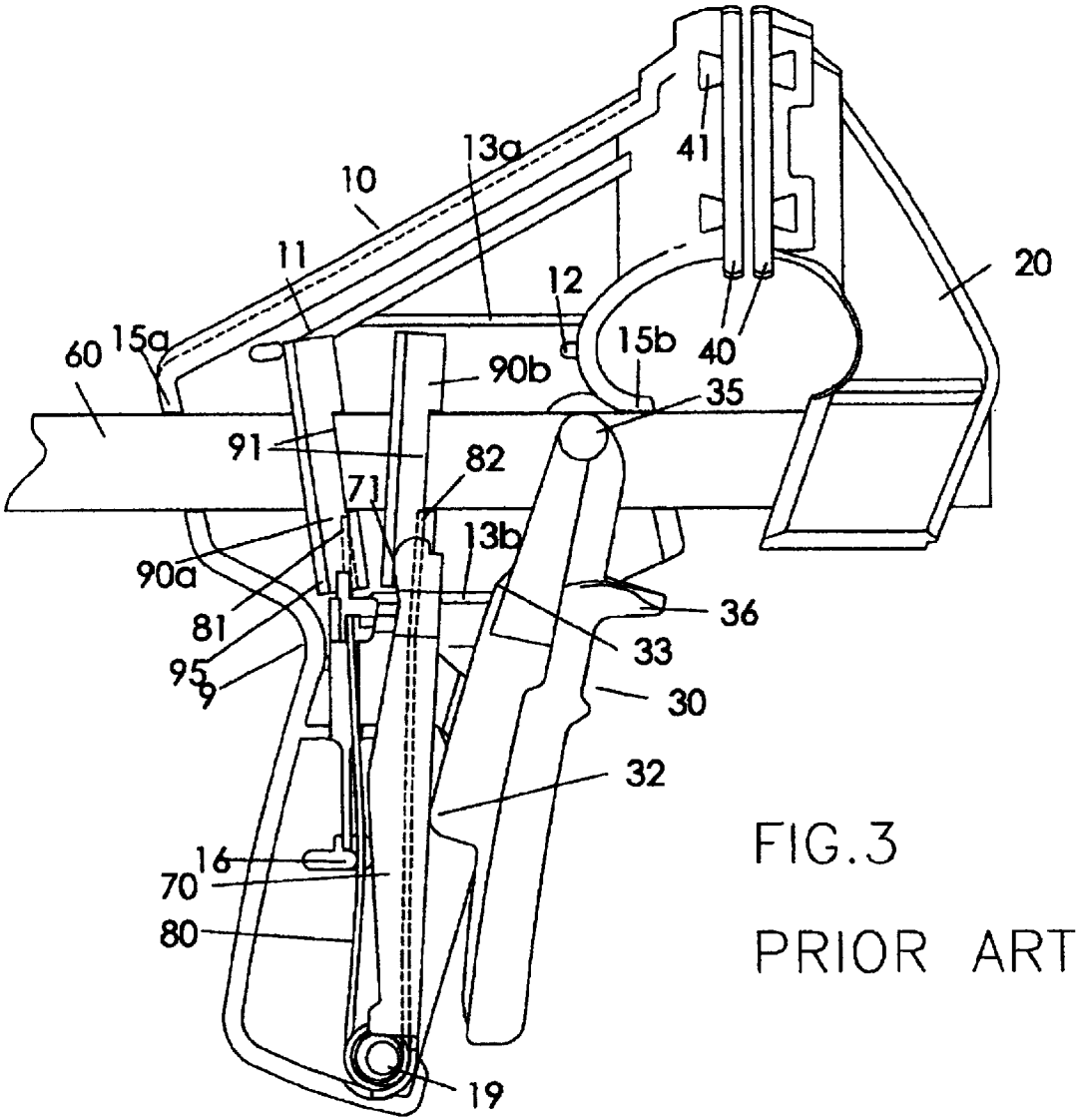
FIG. 3 PRIOR ART
FIG. 3 is the clamp of FIG. 2 in a high speed mode, with the handle depressed and a jaw end advanced toward the body.

FIG. 2 and FIG. 3 show the operation of the present invention clamp. Housing openings 15*a* and 15*b* guide bar 60. In FIG. 2 handle 30 is in its most extended position. Fulcrum 33 of handle 30 is adjacent to a front of channel shaped lever 70. A slight space is shown between fulcrum 33 and lever 70 to enable some freeplay so that bar 60 can slide within drive wedge 90*b* when handle 30 is not being squeezed, as described later. As handle 30 is squeezed through a front portion of the stroke fulcrum 33 presses lever 70, whereby contact 71 of the lever presses a front face of a lower end of flange 95 of wedge 90*b*. End 82 of spring 80 biases wedge 90*b* forward. Spring end 82 is positioned higher against a backside of wedge 90*b* than lever contact 71. The rearward force of lever contact 71 being below the forward force of spring end 82 causes a rotational bias upon wedge 90*b* such that wedge 90*b* remains angled as shown in FIG. 2, where the upper end of the wedge is forward from the lower end. This angle bias is important for the later return stroke action. Spring end 82 is shown forward of contact 71, resting in the channel formed between flanges 95 of wedge 90*b*. As shown, hidden in FIG. 6, the front arm of spring 80 may include bends. These bends help ensure that only end 82 of the spring contacts any element of the mechanism, especially as the spring is deflected and the arm becomes curved such that it could touch the rear side of lever 70. Alternately the front spring arm can be straight and a slot in the face of lever 70 could provide a space for the spring arm to enter. Further a curve along the length of lever 70, convex in front, could also provide clearance for the front spring arm, as well as provide additional separation for fulcrums 32 and 33 of handle 30. However a large curve in the length of lever 70 can lead to complexity as described later.

In a preferred embodiment wedges 90 are formed in a channel section including flanges, or other out of plane shape to provide stiffness using a thin material. If a flat wedge bar were used multiple bars would be needed to have enough strength, and the spring end would not have the channel for positioning. If a flat wedge were desired however, spring end 82 could fit in a small hole or other feature of the wedge, rather than the channel, to position the spring side to side.

As handle 30 is squeezed contact 71 of lever 70 moves wedge 90*b* rearward. Contact 71 slides against wedge 90*b* just enough to compensate for the arc of rotation of lever 70 about pivot 19. Since contact 71 is not extremely frontward nor rearward of pivot 19 contact 71 will have minimal vertical movement and the sliding contact at 71 will be minimal; further linkages are not required. This is possible in part because the front face of lever 70 is straight, or at least nearly so, while the fulcrum points are generated by contours on handle 30. This contrasts with the design of U.S. Pat. Nos. 4,524,650 and 4,739,838 where the contours are on the lever element. In these designs a "curved lever" behind the handle curves substantially forward from a lower pivot mounting. Extra linkages are required to accommodate the large change in distance between the top of the lever and the lower pivot that occurs as the top of the lever moves rearward above the lower pivot point.

Opening 91 (FIGS. 6,8) of wedge 90*b* binds about bar 60 as handle 30 is squeezed. Bar 60 therefore moves along with wedge 90*b*. As the squeeze operation continues the relative angle between handle 30 and lever 70 changes such that handle 30 presses lever 70 at a lower position, fulcrum 32 in FIG. 3. FIG. 3 shows the end of a stroke, but fulcrum 32 remains in contact for the rear portion of the stroke.

The relative rotation speed of the handle and the lever changes as the mechanism moves between the state of FIG. 2 and that of FIG. 3. Specifically fulcrum 33 has high leverage against lever 70 in FIG. 2 since fulcrum 33 is near to handle pivot 35. In FIG. 3 the leverage of fulcrum 32 is lower since fulcrum 32 is further from pivot 35. Conversely the effective speed by which handle 30 can move lever 70, and hence bar 60, is high in FIG. 3 where fulcrum 32 is near to pivot 19. Preferably the edge of handle 30 is slightly convex between fulcrums 32 and 33 so that the transition during use is not abrupt or uncomfortable.

The effect of the "moving fulcrum" illustrated in FIG. 2 and FIG. 3 is a two-speed action. When handle 30 is near to its extended position (FIG. 2) high leverage is provided. This allows a required clamping force. When the handle is nearer to its retracted position (FIG. 3) high speed is provided. This allows the clamp to close quickly without using a second hand to manually move the bar. Because of the high relative speed as in FIG. 3 a small motion of handle 30 gives a large motion of bar 60. More than two distinct fulcrums could be provided, in the extreme a continuously curved fulcrum between 32 and 33 would cause a continuously changing leverage.

A very large handle motion could give both high force and high speed, but this would require an unreasonable gripping distance. Using the moving fulcrum described above allows high speed and high force within a comfortable hand grip area. Friction in the operation is low since there is little sliding between the components. In FIG. 2, fulcrum 33 is nearly aligned with a line connecting pivots 19 and 35. Similarly in FIG. 3, fulcrum 32 is not far from the same imaginary line. Fulcrums 32 and 33 therefore move in nearly the same direction as the corresponding contact surfaces of lever 70. This is a similar effect as described above for pivot 19 relative to contact 71 against the wedge, whereby sliding is minimized.

In a return stroke from the condition of FIG. 3 to that of FIG. 2, wedge 90*b* is moved forward by spring end 82. Lever 70 and handle 30 are in turn moved forward. To prevent binding of wedge 90*b* during the return stroke the bottom of wedge 90*b* must not move forward of the wedge top, as it would then become effectively a forward drive stroke. As described above the relative position of spring end 82 above lever contact 71 ensures the correct wedge angle so that opening 91 maintains clearance about bar 60 during a return stroke. Also since spring end 82 "pulls" contact 71 from in front, wedge 90*b* will stay in contact with both contacts 71 of lever 70 and resist twisting as it returns. At the termination of the return stroke the top of wedge 90*b* contacts rib 12 of housing 10. The slight looseness described above when the handle is fully extended means that wedge 90*b* rotates slightly bottom forward in FIG. 2 from the action of rib 12. Lever 70 moves forward to close the space shown behind fulcrum 33 in FIG. 2. There is then clearance between bar 60 and opening 91 of drive wedge 90*b* so that bar 60 can move forward through drive wedge 90*b* when lock wedge 90*a* is released. In fact fulcrum 33 will normally contact lever 70 in FIG. 2, while handle 30 will have some freeplay until wedge 90*b* rotates about rib 12 enough to bind bar 60 in the drive stroke.

Extension 36 of handle 30 is a support surface. The bottom of extension 36 is relatively parallel to bar 60. As jaw end 20 is extended, the cantilevered weight from bar 60 causes handle 30 to be forced down against the gripping fingers. Extension 36 rests on a top gripping finger and prevents handle 30 from sliding down in a user's hand. Since extension 36 protrudes substantially directly forward, the gripping finger will not slide from under extension 36 easily as handle 30 is released quickly forward. In a further embodiment, not shown, extension 36 could hook downward to provide further support against the finger from sliding out. Recess 9 of housing 10 is at the same height as the space under extension 36 relative to bar 60. The hand can grip the tool immediately under bar 60 where both the tool body and the handle are supported by the gripping hand.

Handle pivots 35 rotate within corresponding recesses of housing 10. Bar 60 is removable without dislocation of any internal parts. Ribs 13*a* and 13*b*, most visible in FIGS. 6 and 9, locate wedge 90*b* in its vertical position when bar 60 is removed. Ribs 13 could equivalently be slots receiving extended tabs, not shown, of wedges 90. The walls of housing 10 position the wedge side to side. Rear lock wedge 90*a* or 90*c* is similarly held from rib 13*a*. Wedge 90*a* and 90*c* may be identical except for the how they are held in housing 10.

Spring 30 is also fully held in position against wedge 90*b* independent of bar 60. The coil of torsion spring 30 is held around pivot 19. The position of spring end 82 is fixed relative to housing pivot 19. Therefore even if the tool is dropped when bar 60 has been removed, wedge 90*b* and spring 30 will not be dislodged. Similarly the position of spring end 81 is also fixed so that the spring that biases lock wedge 90*a* or 90*c* cannot be dislodged. Pivot 19 may be a post or other equivalent structure. This is an improvement from the prior art wherein no wedge bias spring is shown that has a pressing end secured in position against the wedge independently of the bar.

A torsion spring is desirable compared to a more conventional compression spring since it is more compact in the area of bar 60. When used for a long drive stroke as in the present invention the torsion spring will have a lower spring rate with the effect that the reaction force will remain low when drive wedge 90*b* is most rearward. A long stroke compression or extension spring would be difficult to fit in the vicinity of bar 60.

Most advantageously jaw end 20 is removable from the front end of bar 60. Bar 60 may have holes 65 through the thickness of bar 60 at both front and rear ends (FIG. 1, front hole not shown) or equivalent cavity features such as divots or notches. Notches could be in an edge of the bar rather than central in the bar. At a rear end a pin stop may be pressed into hole 65 to prevent bar 60 from falling out of housing 10 in use. Jaw end 20 includes knob 22. Pin 24 extends from knob 22 and slidably through a hole or cavity in the body of jaw end 20 and through a hole similar to hole 65 in bar 60. Bar 60 is shown in FIGS. 1 to 3 filling a cavity or slot in jaw end 20. When knob 22 is pulled jaw end 20 is free to slide off bar 60. The front of bar 60 then has a constant sectional area without obstructions or protrusions, such as a pin stop, to prevent it being pulled out of housing 10 through openings 15*a* and 15*b*. Knob 22 with pin 24 preferably has a stop so that it does not separate from jaw end 22 as it is pulled outward.

A different length bar may then be pushed through housing 10 and attached to jaw end 20. It is helpful to press release button 53 if bar 60 is installed from the rear as would be required if the rear pin stop at hole 65 were not removable. Further, jaw end 20 and bar 60 may be installed oppositely so that jaw end is to the rear of housing 10. Jaw end must be reversed on bar 60 so that pad 40 of the jaw end faces away from the tool body. The clamp is then a spreading device.

If desired, a pin at hole 65 could be removable. Then bar 60 could be removed and installed from either direction. Jaw end 20 could further be permanently fixed to bar 60. But then a complete assembly of bar and jaw end would have to be exchanged to change bar length. Also the option to reverse the jaw end and convert the tool to a spreading device would be lost.

According to the present invention a structure to hold the knob to the jaw is shown in FIGS. 10 to 15. Knob 130 fits about an extended structure of jaw 120. The extension includes guide ribs 124, FIGS. 12 and 13, and an outer terminus of elongated cavity 127. Stop ledge 128 faces toward knob base 122 and channel 129 to define a shelf. The shelf forms a stop for knob 130 whereby stop rib 137 contacts or presses ledge 128 in a fully retracted position of knob 130, FIG. 15. Rib 137 is aligned with ledge 128, with respect to rotation about stem 134, and extends inward from a wall of knob 130 toward stem 134. Preferably an interior of the knob is non-circular or includes ribs so that the knob will not rotate about stem 134. Ribs 124 of the extended structure of jaw 120 serve as guides to prevent such rotation. In the fully engaged position, knob 130 contacts knob base 122, FIG. 14. Cam 123 is an arcuate or non-linear rib. Cam 123 engages rib 137 and causes the rib and its associated wall of knob 130 to deflect as the knob is moved between its operative positions. This deflection is least in the operative positions of FIGS. 14 and 15, greatest in an intermediate position. As a result knob 130 will tend to snap to its operative positions, where the deflection energy within the wall of knob 130 is lowest, and be unstable in intermediate positions where the deflection energy is higher. Such snap action is desirable to help communicate that knob 130 with attached coextending stem 134 is either fully engaged or fully withdrawn from channel 129. The description "knob 130" will be considered to include stem 134. Channel 129 is through a base portion of jaw 120 including a channel width that is horizontal in FIG. 14. Stem 134 passes into the front hole 65 in bar 60 to hold jaw 120 from sliding along bar 60. Cavity 127 extends across a width of channel 129 to a closed end on an opposite side of the channel, FIG. 15. Optionally cavity 127 may extend entirely through the body of jaw 120 to form an exterior opening on the left-side wall in FIG. 15. Bar 60 fits longitudinally through channel 129. Unlike the retractable setscrew 72 of the reference U.S. Pat. No. 5,009,134, the present stem 134 is easily actuated and permanently attached to the jaw.

Figure 10:
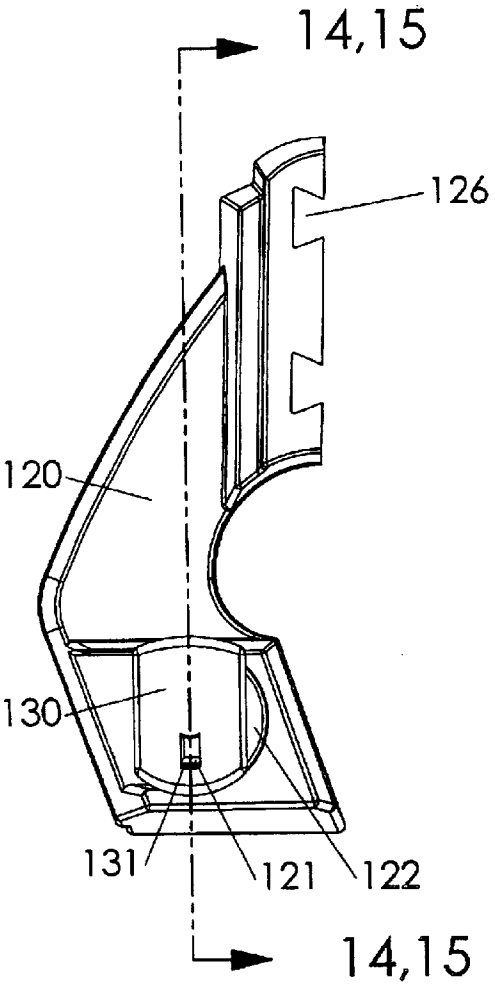
FIG. 10 is a side elevation of a clamp jaw assembly, including a retaining knob, according to a preferred embodiment of the invention.
Figure 13:
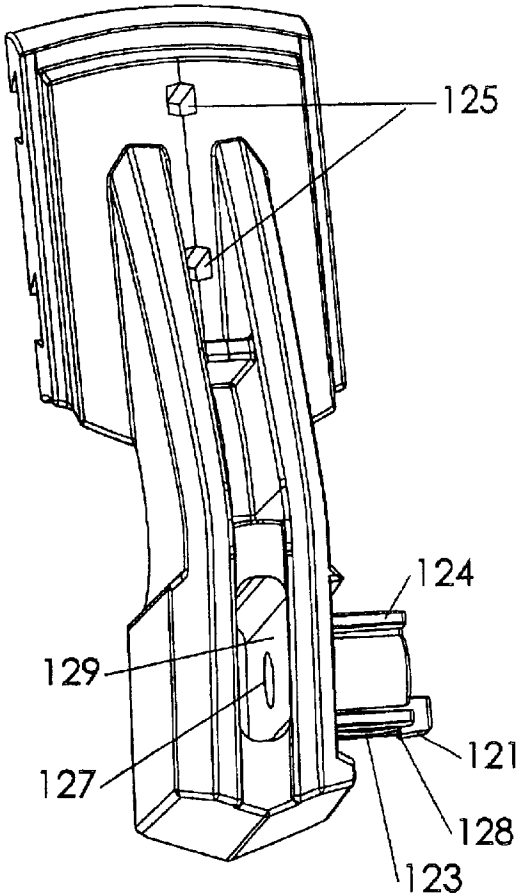
FIG. 13 is a front-side isometric view of the clamp jaw of FIG. 12.
Figure 12A:
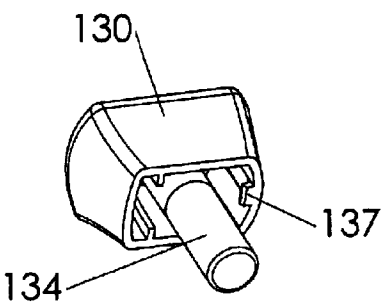
FIG. 12*a* is an interior isometric view of a jaw holding knob.
Figure 12:
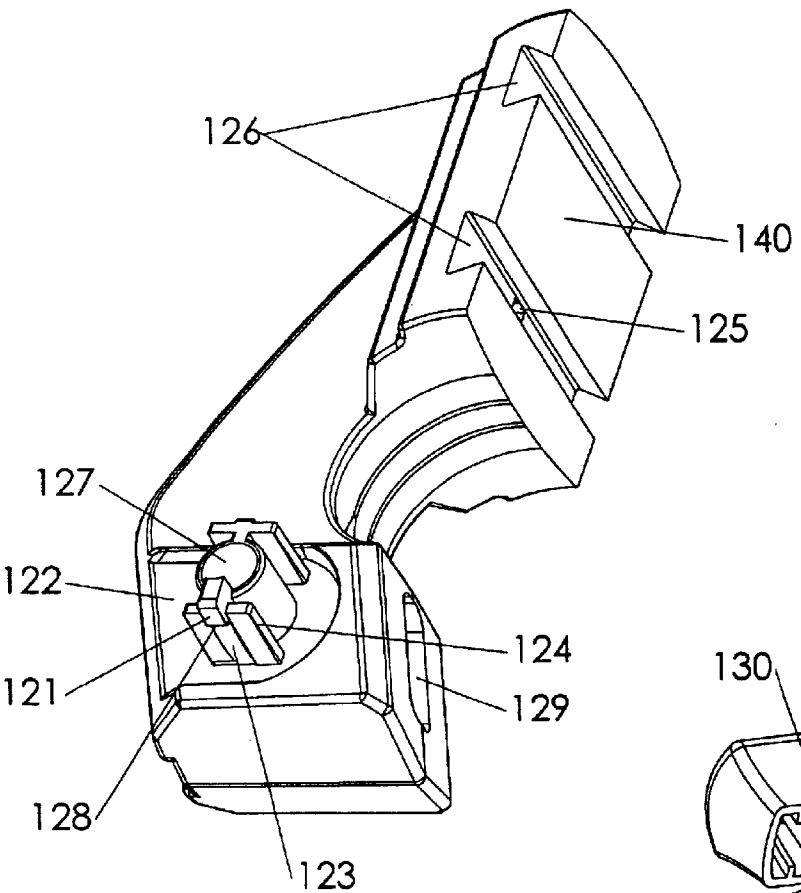
FIG. 12 is a bottom-side isometric view of a clamp jaw according to a preferred embodiment of the invention.
Figure 15:
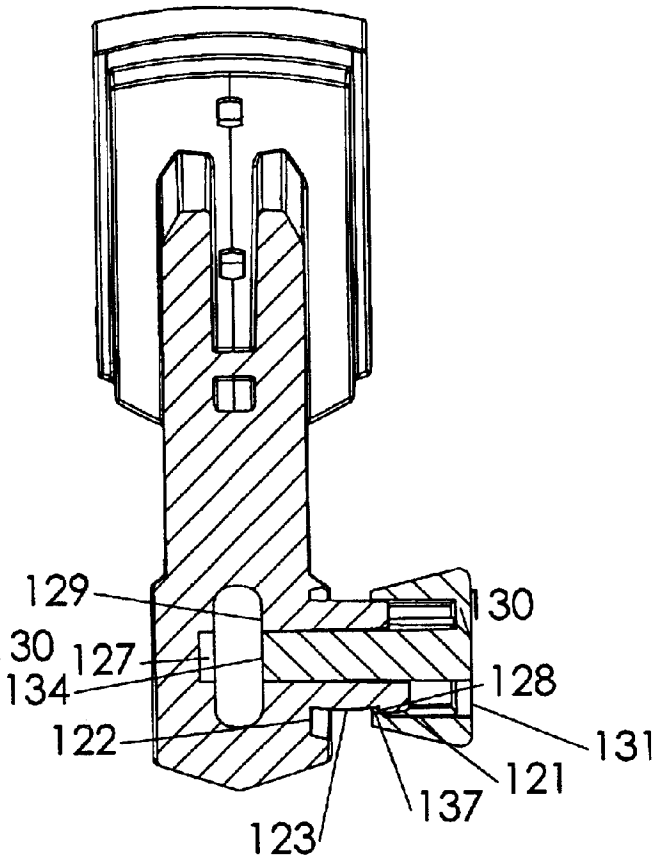
FIG. 15 is the sectional view of FIG. 14, with the knob fully retracted.
Figure 14:
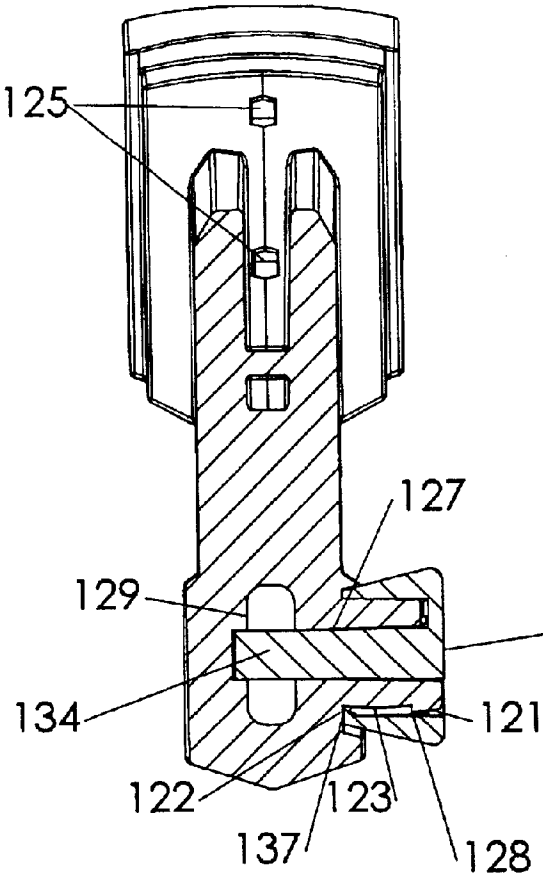
FIG. 14 is a partial sectional view of the jaw of FIG. 10, with the knob fully engaged.

Opening 131 in the outer face of knob 130, FIGS. 10 and 15, extends to rib 137 in the direction of stem 134. Opening 131 is formed by a mold core to create the undercut that defines rib 137. Chamfered ramp 121 deflects rib 137 over ledge 128 during one-time assembly of knob 130 onto the extended structure of jaw 120 that supports the knob. Ramp 121 is at least in part aligned with ledge 128. Ribs 137 or ledge 128 may be plural or circumferential. Lock wedge 90*a* provides the clamp locking force. In the illustrated embodiment lock wedge 90*a* and drive wedge 90*b* are identical for manufacturing convenience. The design of the preferred embodiment clamp as shown in FIGS. 2 and 3 is especially intended to enable use of identical wedges. Stop 11 of housing 10 holds the top of flange 95 of wedge 90*a* in a pivoting relationship and prevents wedge 90*a* from moving forward. End 81 of spring 80 provides a stationary forward bias to the bottom of rear wedge 90*a*. Wedge 90*a* thus binds bar 60 within opening 91 when jaw end 20 is forced forward. Wedge 90*a* could be biased by a separate spring. However for assembly convenience the illustrated embodiment shows end 81 as part of a single piece spring 80. Spring 80 is deflected about rib 16 in housing 10. Rib 16 causes a deflection in the shape of spring 80 where the rear arm of the spring has straight free position. Using a straight segment helps maintain a tight tolerance in the bias force since with a bend, the bend angle can vary.

Figure 6:
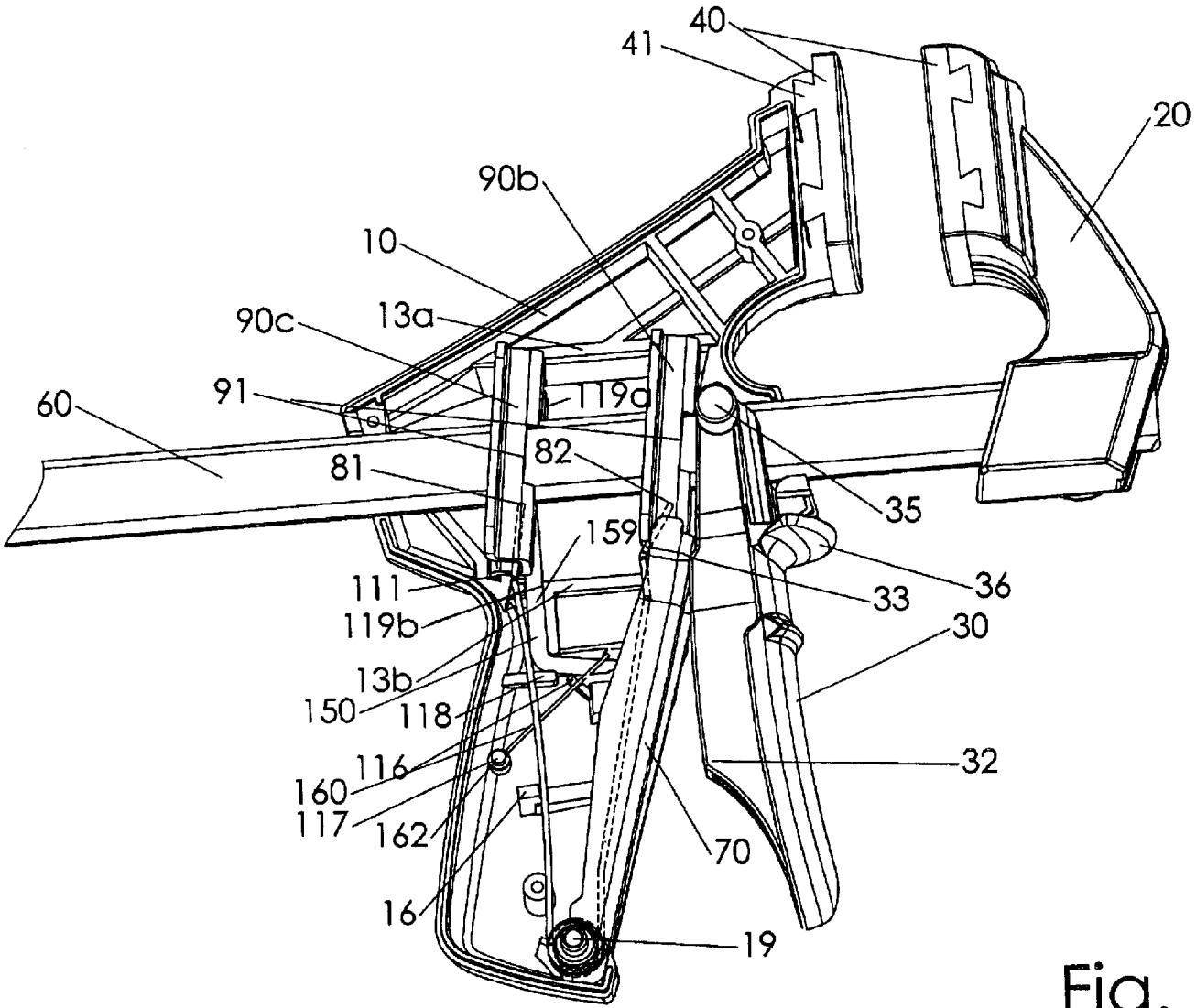
FIG. 6 is an isometric view of the clamp of FIG. 4, view from an opposite side, with a right side of the housing removed.

According to the present invention lock wedge 90*c* is angled relative to the bar, behind and generally parallel to drive wedge 90*b* FIG. 6. A front face of lock wedge 90*c* pivots about stop 111, FIG. 9, at the bottom of the lock wedge. Spring end 81 presses forward on lock wedge 90*c* above stop 111, FIG. 6. This configuration contrasts with the top positioned stop 11 shown in FIGS. 2 and 3 where the two wedges are at respective angles to each other. According to the present invention all the forces on bar 60 include a clockwise direction in FIG. 6, or downward at the end with jaw 120. In contrast, with lock wedge 90*a* pressing upper stop 11, the lock wedge creates a counterclockwise bias, or upward at jaw 20, upon bar 60. This is because lock wedge 90*a* in FIG. 2 includes its own counterclockwise bias as the bar is pulled outward, to the right in FIG. 2. Since the bar includes some free play as it passes through openings 15*a* and 15*b*, FIG. 9, upper stop 11 pressing wedge 90*a* would cause jaw 120 to move up as it tightens about an object to be clamped. The jaw ultimately moves back down in a "make-up" motion as clamping force creates the clockwise bias to overcome the opposing rotational bias from upper stop 11. This extra motion causes a less rigid holding action by the clamp. With lower stop 111 the jaw end of bar 60 is always biased downward, so there is no make-up motion and the holding action is very rigid.

A further advantage of the wedges being parallel to each other is that the assembly of the two wedges can be more compact compared to the configuration of FIG. 3. Note in FIG. 3 the tops of the wedges are well separated with the top of the rear wedge extending far toward the rear of housing 10. According to the present invention, best seen in FIG. 5, the top of the rear wedge is more forward. This improvement allows contour 105, FIGS. 4 and 5, of housing 10 to be less protruding and better integrated in appearance.

Figure 9:
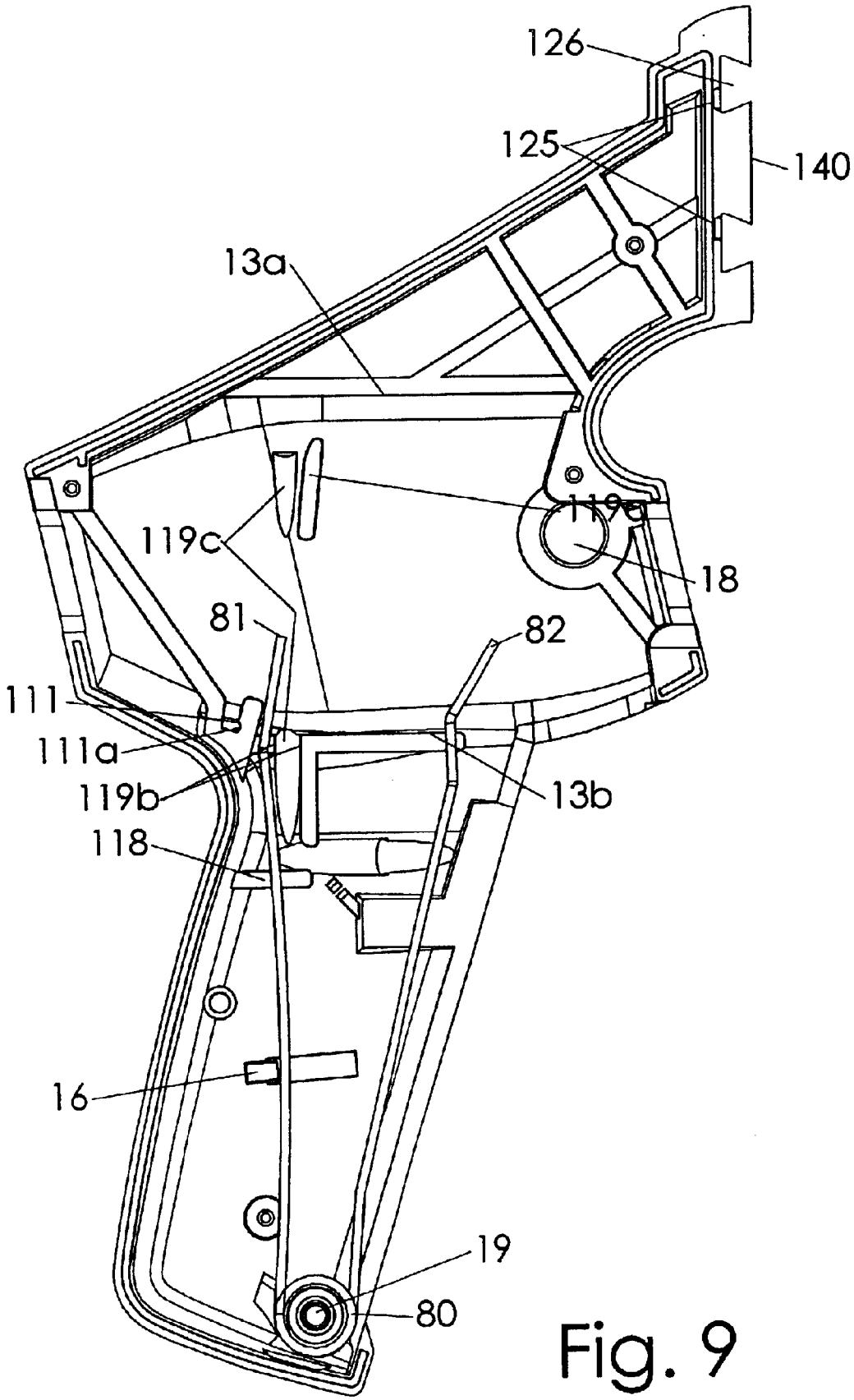
FIG. 9 is a side elevation of a left side of the clamp housing, including the release wire and bias spring.
Figure 11:
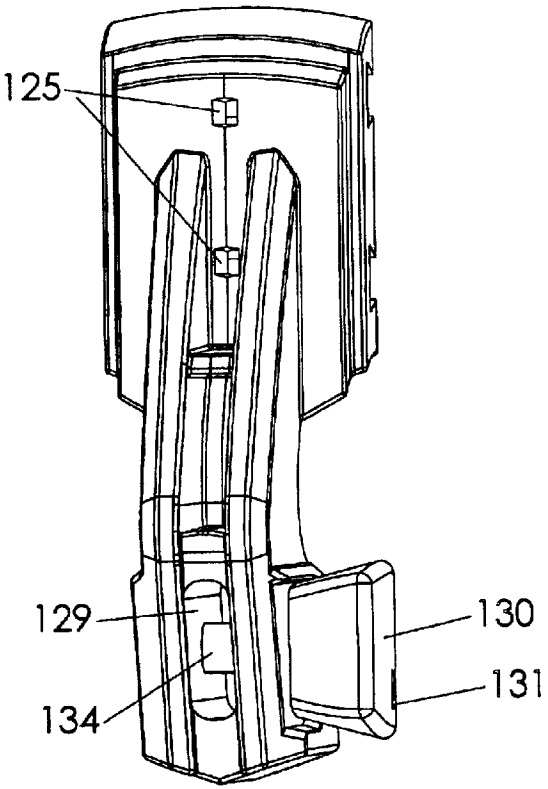
FIG. 11 is a rear-side view of the clamp jaw assembly of FIG. 10.

In FIG. 9 recess 111*a* is seen just under stop 111. This recess prevents the bottom edge of lock wedge 90*c* from digging into or trying to climb up a face of the rib comprising stop 111.

Figure 5:
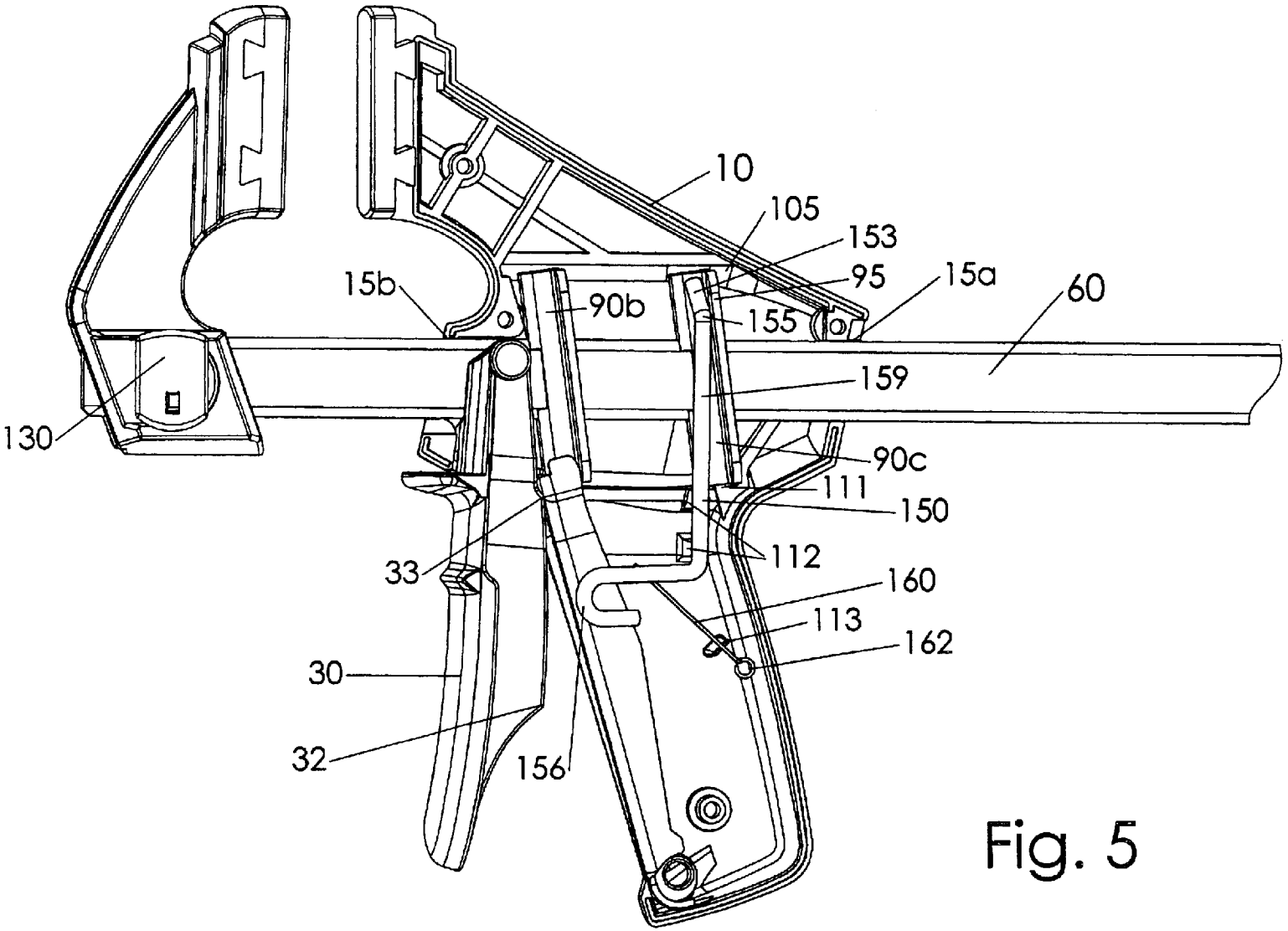
FIG. 5 is a side elevation of the clamp of FIG. 4, with a left side of the housing removed, and a release wire and bias spring in their respective positions when supported by the left housing side.
Figure 8:
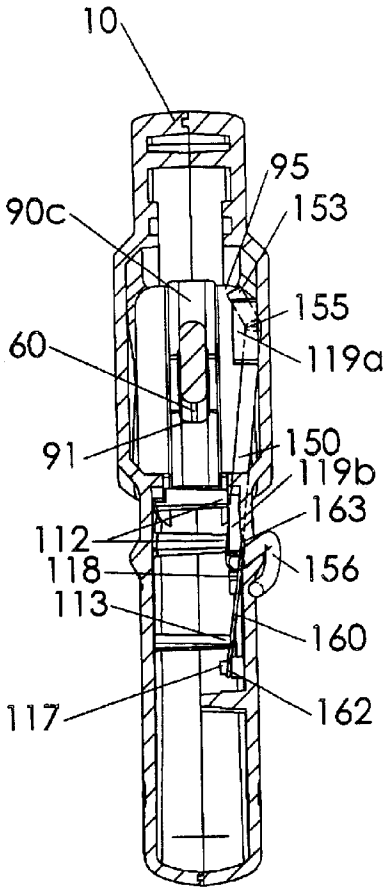
FIG. 8 is a partial section view of the clamp of FIG. 8, showing details of a simplified release button and linkage.
Figure 7:
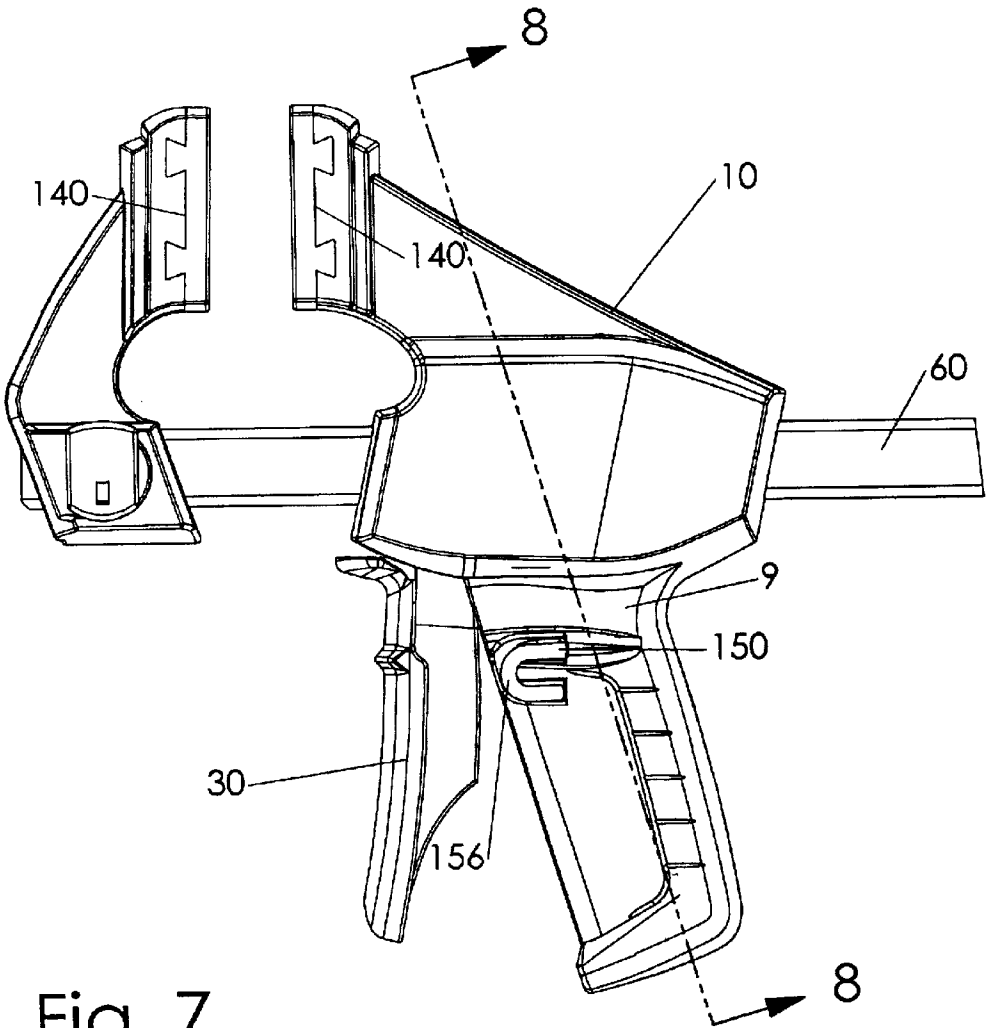
FIG. 7 is a side elevation of the clamp of FIG. 4, showing a section line for reference.

To release jaw 120 and bar 60, the top of lock wedge 90*c* is pressed rearward by bent end 153 of wire form 150 causing the wedge to pivot about stop 111, FIGS. 5, 6 and 8. According to the present invention wire form 150 provides a linkage to create a release tab for this purpose. Wire form 150 is held in a substantially vertical position at rotation axle 159 by ribs 119*a* and 119*b*, FIGS. 6 and 9. Grooves 119*c* provide further guidance and clearance for wire form 150. Opposite grooves 119 are tall ribs 112, FIG. 8, to hold the wire from the right side housing. Rib 118 provides a lower guide to position wire form 150.

Figure 4:
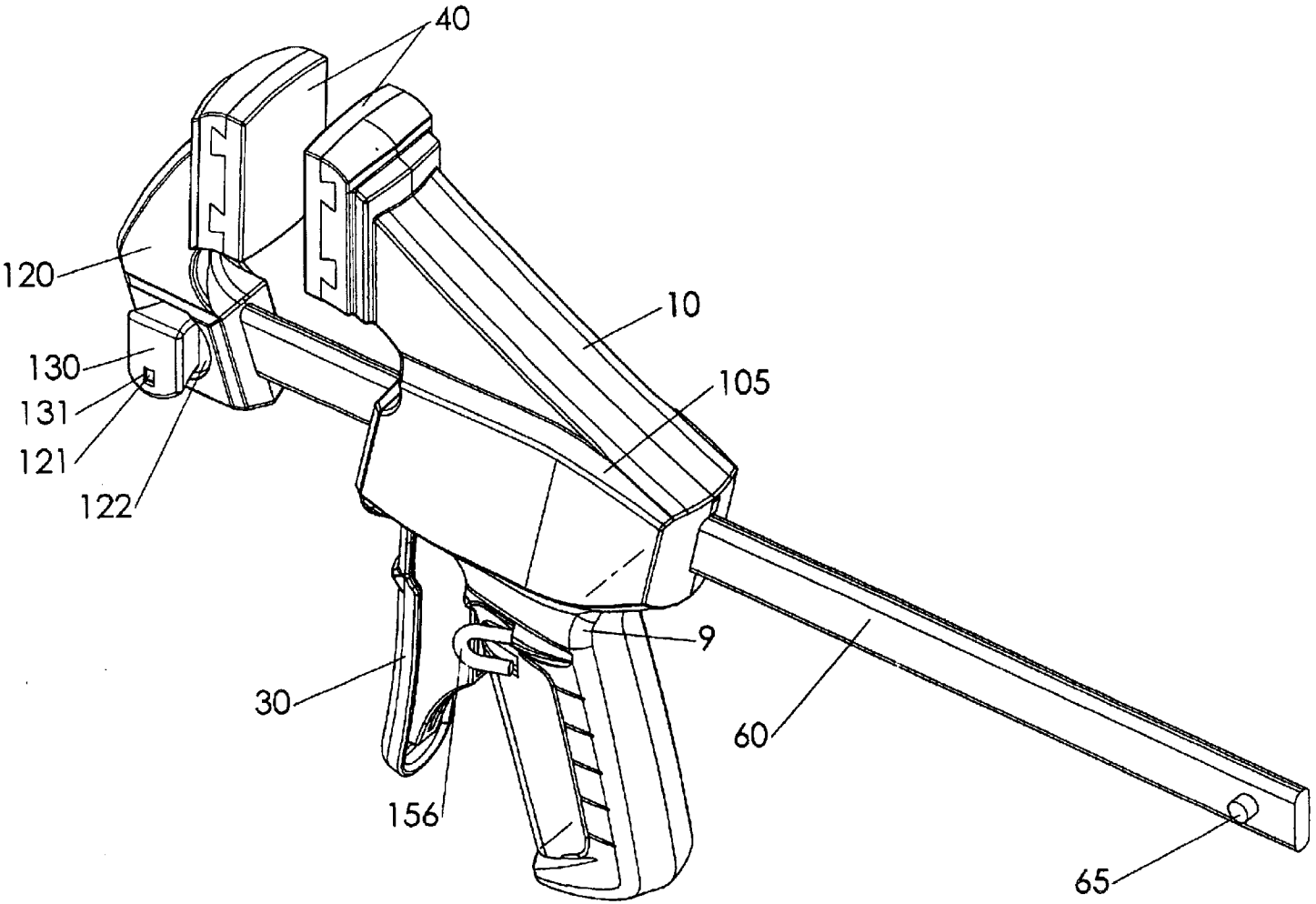
FIG. 4 is a rear-top isometric view of a quick action clamp according to a preferred embodiment of the invention.

Wire form 150 includes off-axis upper bent end 153, with the axis defined by the rotation axle. Lower end 156 is a button or pressing end also off-axis. In the illustrated embodiment pressing end 156 forms a button from a wire segment that is bent 1800 to form a "U" shaped portion. Other options include any loop shape including a fully circular wire shape, or a simple straight segment. When lower end 156, FIGS. 4 and 5, is pressed inward, bent end 153 serves as an actuating end. Bent end 153 rotates and moves rearward. Bent end 153 presses flange 95 of lock wedge 90*c* at the top portion of lock wedge 90*c* above bar 60, causing wedge 90*c* to unbind bar 60. When lower end 156 is released to move away from housing 10, bent end 153 moves forward and wedge 90*c* again binds bar 60 against moving forward, right in FIG. 6. Wire form 150 provides a compact element to transmit rotational force from lower end 156 to upper bent end 153. Vertex 155 defines bent end 153 and presses the rear face of rib 119*a*. In FIG. 8 vertex 155 is shown hidden behind rib 119*a*. The uppermost groove 119*c*, FIG. 9, provides extra clearance for a longer and more sharply bent segment of bent end 153.

Wire spring 160 biases lower end 156 of wire form 150 away from housing 10, FIG. 6. This also biases bent end 153 away from flange 95 of lock wedge 90*c*. Without spring 160, in certain positions gravity acting on lower end 156 will cause bent end 153 to lightly press flange 95. This can reduce the reliability of wedge 90*c* from binding bar 60. Loop 162 holds spring 160 in position over post 117. Notch 116 further positions spring 160. Tall rib 113, FIGS. 5, and 8 presses spring 160, into the page in FIG. 6. The distal end of spring 160 presses wire form 150. Other types, materials and configurations of spring 160 may be used.

Figure 16:
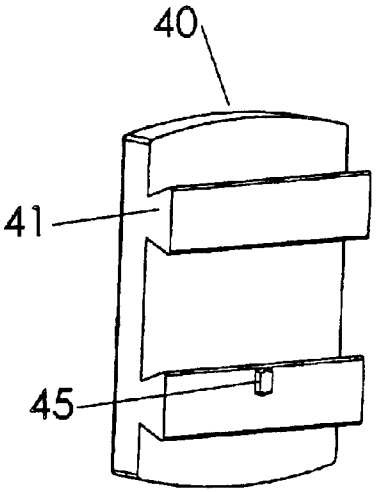
FIG. 16 is an isometric view of a gripping pad.

Gripping pads 40 fit against respective clamping surfaces 140 of housing 10 and jaw 120. The clamping surfaces include recesses 125 within lateral dovetail grooves 126, FIGS. 9, and 14. Recesses 125 extend through the front of jaw 120, FIG. 13, to facilitate molding. Pads 40 are of resilient material so bump 45, FIG. 16, snaps into recess 125 to hold pad 40 from sliding out of grooves 126 after the pads are assembled by sliding ribs 41 into grooves 126. Optionally only one dovetail rib 41 may have a bump 45 on each pad as shown. Note that in FIG. 9 only one half of each recess 125 is shown, corresponding to the left half of housing 10 shown.

With respect to knob 130, in the illustrated embodiment the knob is fixed rotationally about stem 134. However if one of ribs 137 and ledge 128 are fully or nearly circumferential about stem 134, then the interior of knob 130 may be more circular whereby knob 130 can rotate partially of fully about stem 134, while respective ledges and ribs remain aligned to limit outward motion of knob 130 along the axis defined by stem 134.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims following.

What is claimed is:

1. A quick action clamp including a housing with a housing top, bottom, front and rear, an elongated horizontal bar slidably disposed within the housing, a handle pivotably attached to the housing at a handle pivot, an elongated drive wedge surrounding the bar, the handle linked to the drive wedge where rotating the handle causes the drive wedge to be pressed near one end to bind the bar and to cause the drive wedge to move along with the bar in a first horizontal direction, the drive wedge moving in a second horizontal direction in a return stroke action, an elongated lock wedge surrounding the bar and pivotably pressing the housing at one end of the lock wedge, the lock wedge normally binding against the bar to prevent the bar from moving in the second horizontal direction, a release tab extends from the housing and is exposed on at least one side of the housing, the release tab being linked to the lock wedge such that moving the release tab causes the lock wedge to release from the bar, wherein:

the release tab includes an elongated wire form, a lower end of the wire form comprising a pressing end, an upper bent end comprising an actuating end;

an intermediate portion of the wire form including a rotation axle that fits within guide ribs of the housing, the rotation axle being between the upper bent end and the lower pressing end;

the upper bent end being off-axis with respect to the rotation axle and actuating against a portion of the lock wedge above the bar;

the lower pressing end being off-axis with respect to the rotation axle and being below the bar.

2. The bar clamp of claim 1 wherein the lower pressing end of the wire form includes a button formed from a loop shaped segment of the wire form.

3. The bar clamp of claim 2 wherein the loop is a "U" shaped wire portion.

4. The bar clamp of claim 1 wherein a spring presses the wire form at a location between the rotation axle and the pressing end.

5. A bar clamp including a housing, a clamping surface extending from the housing, openings in a front and a rear of the housing to slidably fit an elongated bar, an elongated handle pivotably attached to the housing toward the front of the housing at a handle pivot, the handle projecting away from the bar, a jaw attached to a front end of the bar whereby rotating the handle toward the housing causes the jaw to be drawn toward the housing, the bar including a cavity through a thickness of the front end of the bar, the jaw including:

a channel through a base portion of the jaw to slidably fit the bar;

an elongated cavity extending across a width of the channel, the cavity extending through the jaw to at least one open end of the cavity;

a knob fitted about an extended structure of the jaw, the knob including a coextending stem;

the knob including an engaged position wherein the stem extends into the elongated cavity across the channel, and a retracted position wherein the stem is withdrawn from the channel;

a stop rib extending from a wall of the knob toward the stem to form an undercut within the knob;

a stop ledge of the jaw forming a shelf facing the channel, the ledge being an element of the extended structure of jaw, the ledge being aligned with the stop rib of the knob;

the retracted position of the knob including a contacting relationship between the jaw stop ledge and the knob stop rib.

6. The bar clamp of claim 5 wherein the knob includes an opening that extends in the direction of the stem from an outer face of the knob to the stop rib of the knob.

7. The bar clamp of claim 5 wherein the extended structure of the jaw includes guides to fix the knob against rotation about the stem.

8. The bar clamp of claim 5 wherein the extended structure includes a cam surface, the cam surface contacting the stop rib of the jaw, the knob including an intermediate position between the engaged position and the retracted position, the cam pressing the stop rib to cause the wall of the knob to deflect when the knob is in the intermediate position.

9. The bar clamp of claim 5 wherein a ramp of the extended structure is adjacent to and aligned with the ledge, and during an initial assembly operation including the knob being pressed onto the extended structure, the ramp deflects the wall of the knob over the ledge.

10. A bar clamp including a housing, a first clamping surface of the housing, openings in a front and a rear of the housing to slidably fit an elongated bar, an elongated handle pivotably attached to the housing toward the front of the housing at a handle pivot, the handle projecting away from the bar, a jaw attached to a front end of the bar whereby rotating the handle toward the housing causes the jaw to be drawn toward the housing, the jaw including a second clamping surface, each of the first and second clamping surfaces abutting a gripping pad and having lateral grooves to accept corresponding ribs of the clamping pad, the pad being of resilient material wherein:

at least one rib of each pad includes a bump extension on the rib;

the first and second clamping surfaces each including at least one groove having a recess in the groove;

the bump extensions of the ribs extending into the recesses of the grooves to hold the gripping pads in a lateral position upon the respective clamping surfaces.

* * * * *